US011199314B1

(12) United States Patent
Wu

(10) Patent No.: US 11,199,314 B1
(45) Date of Patent: Dec. 14, 2021

(54) LIGHTING APPARATUS AND MANUFACTURING METHOD THEREOF

(71) Applicant: Jinjiang Wonderful Photoelectric Lighting Co., Ltd., Fujian (CN)

(72) Inventor: Qingbiao Wu, Fujian (CN)

( * ) Notice: Subject to any disclaimer, the term of this patent is extended or adjusted under 35 U.S.C. 154(b) by 0 days.

(21) Appl. No.: 17/160,423

(22) Filed: Jan. 28, 2021

(30) Foreign Application Priority Data

Dec. 4, 2020 (CN) ..... 202011410702.9

(51) Int. Cl.

| | |
|---|---|
| ***F21V 19/00*** | (2006.01) |
| ***F21V 3/00*** | (2015.01) |
| ***F21V 23/00*** | (2015.01) |
| ***F21V 17/06*** | (2006.01) |
| ***F21Y 115/10*** | (2016.01) |

(52) U.S. Cl.
CPC ..... *F21V 19/004* (2013.01); *F21V 3/00* (2013.01); *F21V 17/06* (2013.01); *F21V 23/001* (2013.01); *F21Y 2115/10* (2016.08)

(58) Field of Classification Search
CPC ..... F21V 19/004; F21V 3/00; F21V 17/06; F21V 23/001
USPC ..... 362/311.01
See application file for complete search history.

(56) References Cited

U.S. PATENT DOCUMENTS 7,484,863 B1 * 2/2009 Aubrey ..... F21V 13/04 362/294
8,282,250 B1 * 10/2012 Dassanayake ..... F21K 9/23 362/373
2010/0026185 A1 * 2/2010 Betsuda ..... F21V 29/67 315/32
2010/0096992 A1 * 4/2010 Yamamoto ..... F21V 19/0055 315/112
2011/0163668 A1 * 7/2011 Jonsson ..... F21K 9/23 315/51
2011/0221322 A1 * 9/2011 Lai ..... F21V 29/74 313/46
2012/0236573 A1 * 9/2012 Yamamoto ..... F21K 9/232 362/311.02
2012/0275170 A1 * 11/2012 Li ..... F21V 29/773 362/373
2015/0308630 A1 * 10/2015 Bendtsen ..... F21V 7/0066 362/235
2017/0227170 A1 * 8/2017 Wang ..... F21V 23/006

* cited by examiner

*Primary Examiner* — Bryon T Gyllstrom
(74) *Attorney, Agent, or Firm* — Prakash Nama; Global IP Services, PLLC

(57) ABSTRACT

The present invention discloses a lighting apparatus and manufacturing method thereof, including a lampshade, a lamp holder, a light source component and an electronic component; the light source component and the electronic component are electrically connected with each other; the lampshade includes a lampshade body and a mounting part; the mounting part is inserted into the lamp holder; the mounting part is engaged with a lamp pole by interference fit; the lamp pole is provided with through holes for the electronic component or wire to pass through; each of the through holes passes from a first side of the lamp pole to a second side of the lamp pole. The electronic component of the lighting apparatus of the present invention passes through the through hole of the lamp pole, thereby effectively prevent displacement of the electronic component and decreasing attrition rate of the lighting apparatus.

12 Claims, 14 Drawing Sheets

LIGHTING APPARATUS AND MANUFACTURING METHOD THEREOF

BACKGROUND OF THE INVENTION

The present invention relates to lighting apparatus and more particularly a lighting apparatus and manufacturing method thereof.

With developments in economic society and improvements in lighting apparatus and technology, lighting apparatus is widely used in our daily life, as well as in various occasions outdoor, such as outdoor landscape lighting, luminaire lighting, large scale architecture lighting and so forth.

To solve the problem concerning damages caused by rain water entering outdoor lighting apparatus, the lighting apparatus in the prior art are packaged in a sealed manner; that is, resin adhesive is filled in two sides of the LED bead and the printed circuit board (PCB), so that rain water could not directly contact the LED bead and the printed circuit board, thereby achieving waterproof effect. However, the waterproof effect is only average; once rain water enters and damages the printed circuit board, the entire lighting apparatus is scrapped.

BRIEF SUMMARY OF THE INVENTION

The present invention provides a lighting apparatus which is simple in structure, low in costs, and has good waterproof effect.

To attain this, the present invention adopts the following technical proposal: A lighting apparatus comprising lampshade, a lamp holder connected to the lampshade, and an electronic component and a light source component which are electrically connected with each other and disposed inside the lampshade; the lampshade comprises a lampshade body and a mounting part integrally connected on the lampshade body; the mounting part is inserted into the lamp holder; characterized in that: the mounting part is engaged with a lamp pole by interference fit; the lamp pole is provided with through holes for the electronic component or wire to pass through; each of the through holes passes from a first side of the lamp pole to a second side of the lamp pole.

In a preferred embodiment of the present invention, the lamp pole is a cylindrical lamp pole; the lamp pole has a diameter which decreases gradually from a first end close to the lamp holder to a second end distant from the lamp holder.

In a preferred embodiment of the present invention, it further comprises a first wire and a second wire; the first wire comprises a first electrical connection end which is electrically connected with a power supply and a first connection end which is electrically connected with the light source component; the second wire comprises a second electrical connection end which is electrically connected with the power supply and a second connection end which is electrically connected with the light source component.

In a preferred embodiment of the present invention, the electronic component comprises a first electronic component; the first electronic component is disposed on the light source component and electrically connected with the light source component; the first wire and the second wire are respectively electrically connected with the light source component; the through holes comprise a first through hole and a second through hole; the first wire passes through the first through hole and is disposed in the first through hole; the second wire passes through the second through hole and is disposed in the second through hole.

In a preferred embodiment of the present invention, the electronic component comprises a first electronic component and a second electronic component; the first electronic component is disposed on the light source component and electrically connected with the light source component; the first wire is electrically connected with the second electronic component; the second wire is electrically connected with the light source component; the through holes comprise a first through hole and a second through hole; the second electronic component passes through the first through hole and is disposed in the first through hole; the second wire passes through the second through hole and is disposed in the second through hole.

In a preferred embodiment of the present invention, the electronic component comprises a first electronic component, a second electronic component and a third electronic component; the first electronic component is disposed on the light source component and electrically connected with the light source component; the first wire is electrically connected with the second electronic component; the second wire is electrically connected with the third electronic component; the through holes comprise a first through hole and a second through hole; the second electronic component passes through the first through hole and is disposed in the first through hole; the third electronic component passes through the second through hole and is disposed in the second through hole.

In a preferred embodiment of the present invention, the light source component comprises a PCB; the PCB is disposed on one end of the lamp pole; at least one LED is adhered or welded on a side of the PCB which faces towards the lampshade body.

In a preferred embodiment of the present invention, a supporting platform is provided on a side of the lamp pole which is close to the PCB for preventing the PCB from disengaging from the lamp pole; PCB grooves which correspond to the supporting platform are provided on the PCB at positions corresponding to the supporting platform; the PCB grooves are snapped on the supporting platform.

In a preferred embodiment of the present invention, a gripping part is provided on a side of the lamp pole which is distant from the light source component.

In a preferred embodiment of the present invention, a limiting protruding pole member is arranged to extend towards a direction away from the light source component from a periphery of the through hole to prevent displacement of the electronic component.

In a preferred embodiment of the present invention, an annular groove is provided circumferentially on an outer surface of the lamp pole; a sealing ring is disposed in the annular groove.

In a preferred embodiment of the present invention, the lamp pole comprises a first lamp pole and a second lamp pole connected with the first lamp pole; a snapping mechanism for snap connection is provided on a first side of the first lamp pole and a first side of the second lamp pole which face each other.

Another object of the present invention is to provide a lighting apparatus manufacturing method which is simple to operate, lower in costs and has good waterproof effect.

To attain this, the present invention adopts the following technical proposal: A lighting apparatus manufacturing method, wherein the lighting apparatus is the lighting apparatus described above; the light source component comprises a PCB; at least one LED is adhered or welded on the PCB; PCB grooves are disposed on the PCB; it comprises the following steps:

S1: Obtain the lampshade by injection molding;

S2: Obtain the lamp pole by injection molding; the supporting platform and the gripping part are simultaneously formed during injection molding of the lamp pole;

S3: Affix the LED and the first electronic component on corresponding positions of the PCB, and then weld the LED and the first electronic component respectively on the PCB by reflow soldering;

S4: Connect the second electronic component with the first wire by welding; insert the first connection end and the second connection end corresponding to L, N labels of the PCB, and then apply solder;

S5: Inspect visually if surface of the PCB is clean, and whether there is any missing solder or whether there is sufficient solder at the LED, the first electronic component, the first connection end and the second connection end; then use AC120 V60 HZ power supply and perform lighting test using a test probe;

S6: Pass the second electronic component and the second wire through the first through hole and the second through hole respectively, then press and rest the PCB grooves of the PCB on the supporting platform to obtain a first assembled part;

S7: Align the first assembled part obtained in Step S6 with the mounting part, and press and install the same in place;

S8: An outer wall of the gripping part and an inner wall of the mounting part form a receiving space; drip appropriate amount of glue in the receiving space;

S9: Bend the second electrical connection end from a side of the lampshade to adhere to a screw-threaded surface of the lampshade, and pass the first electrical connection end through a land hole on a top part of the lamp holder, and then screw a screw socket of the lamp holder according to its thread direction to tightly engage with the lampshade;

S10: Apply solder to the land hole on the top part of the lamp holder, wherein welding points are required to be in circular shape, smooth in surface and without burrs;

S11: Inspect visually outer appearance of the lighting apparatus with solidified glue, and check whether there is any glue leakage, whether the screw socket is in place, and whether there is any foreign matter in the lampshade, then use AC120V 60 HZ power to perform testing, With the aforementioned technical proposal, the lighting apparatus of the present invention has the following advantageous effects:

1. With the interference fit between the mounting part and the lamp pole, the lamp pole is pressed into the mounting part of the lampshade, thereby forming a good sealing effect between the lamp pole and the lampshade, so that the light source component in the lampshade has good waterproof effect, and the waterproof level of the lighting apparatus is increased;

2. By arranging the electronic component to pass through the through hole of the lamp pole, the through hole effectively limits displacement of the electronic component or the wire, thereby reducing attrition rate of the lighting apparatus;

3. The sealing ring disposed on the periphery of the lamp pole improves the waterproof effect of the light source component and the electronic component in the lampshade, thus further increasing the sealing effect between the lamp pole and the lampshade, and further effectively increasing the waterproof level of the lighting apparatus;

4. By filling glue in the receiving space, the waterproof level of the lighting apparatus if further effectively increased;

5. The manufacturing method of the present invention is simpler and lower in costs.

Figure 1:
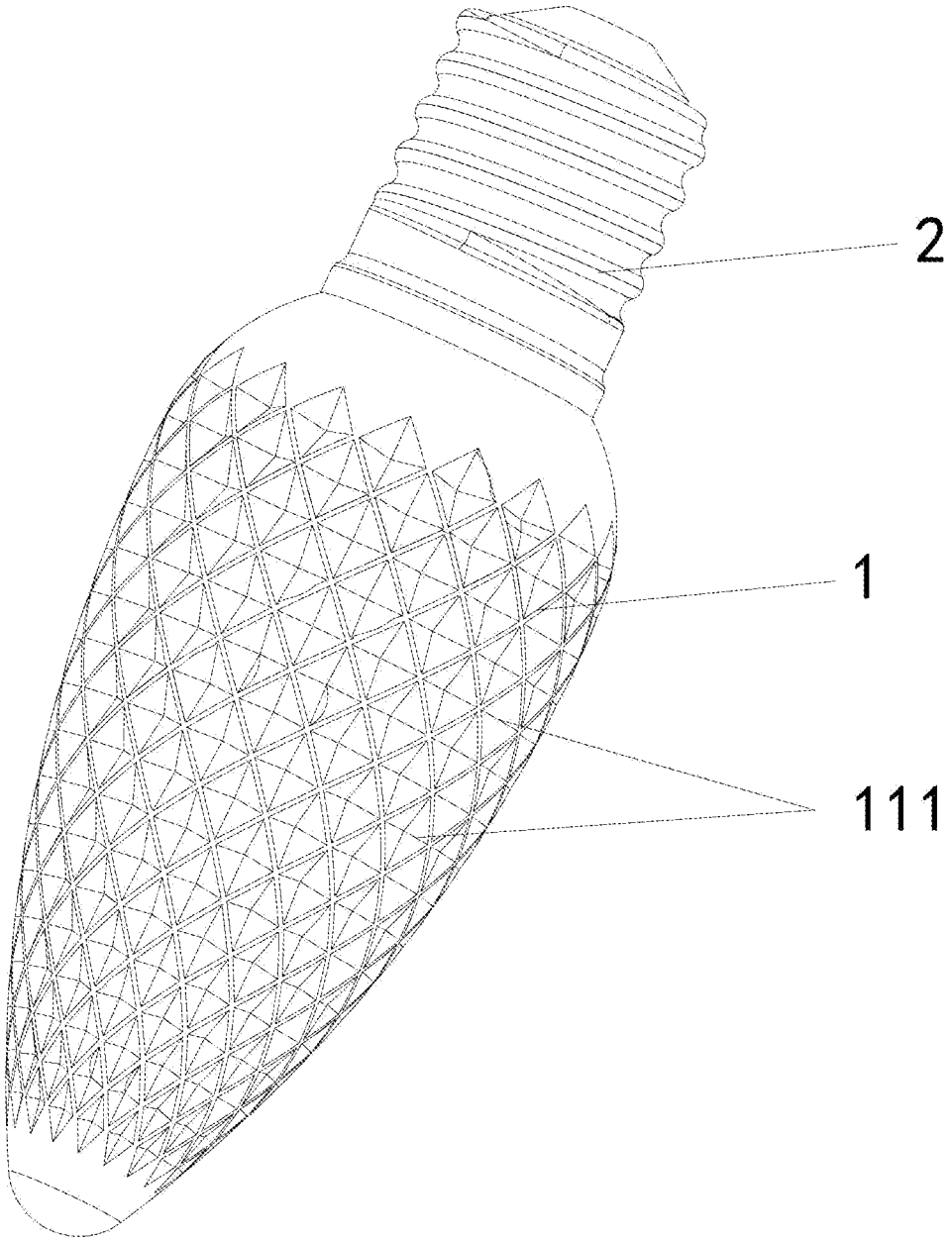
FIG. 1 is a structural schematic view of the present invention.
Figure 2:
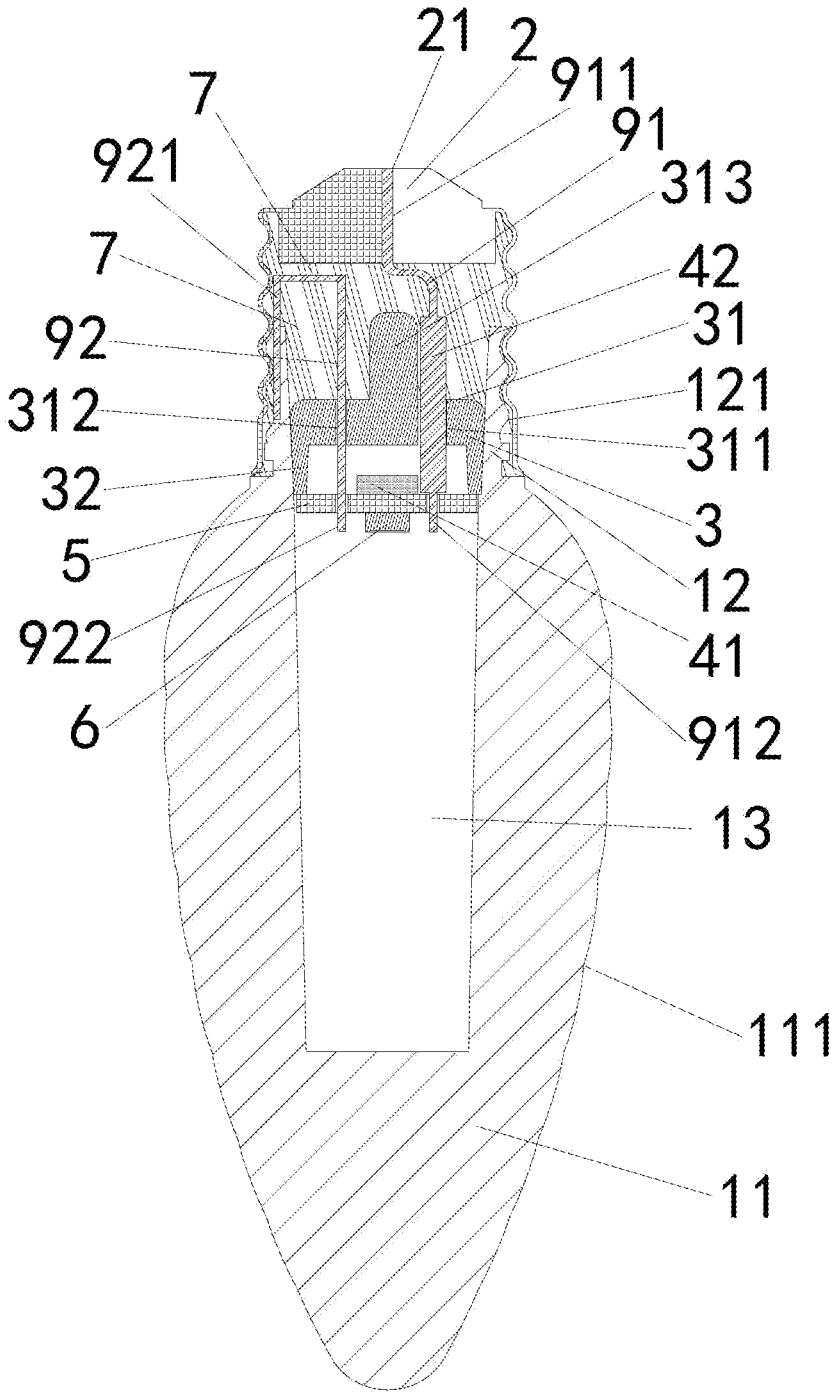
FIG. 2 is a sectional structural schematic view of the Embodiment 1 of the present invention.
Figure 3:
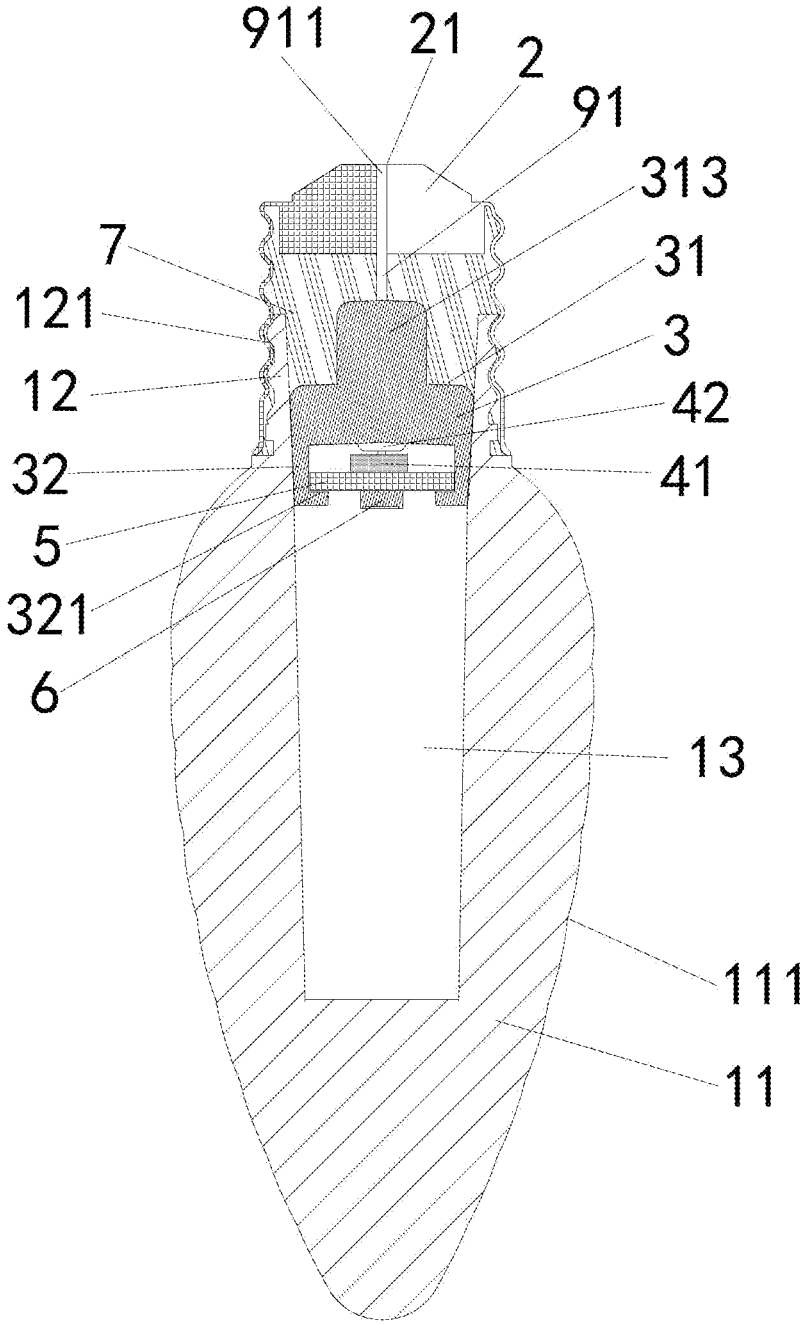
FIG. 3 is another sectional structural schematic view of the Embodiment 1 of the present invention.
Figure 4:
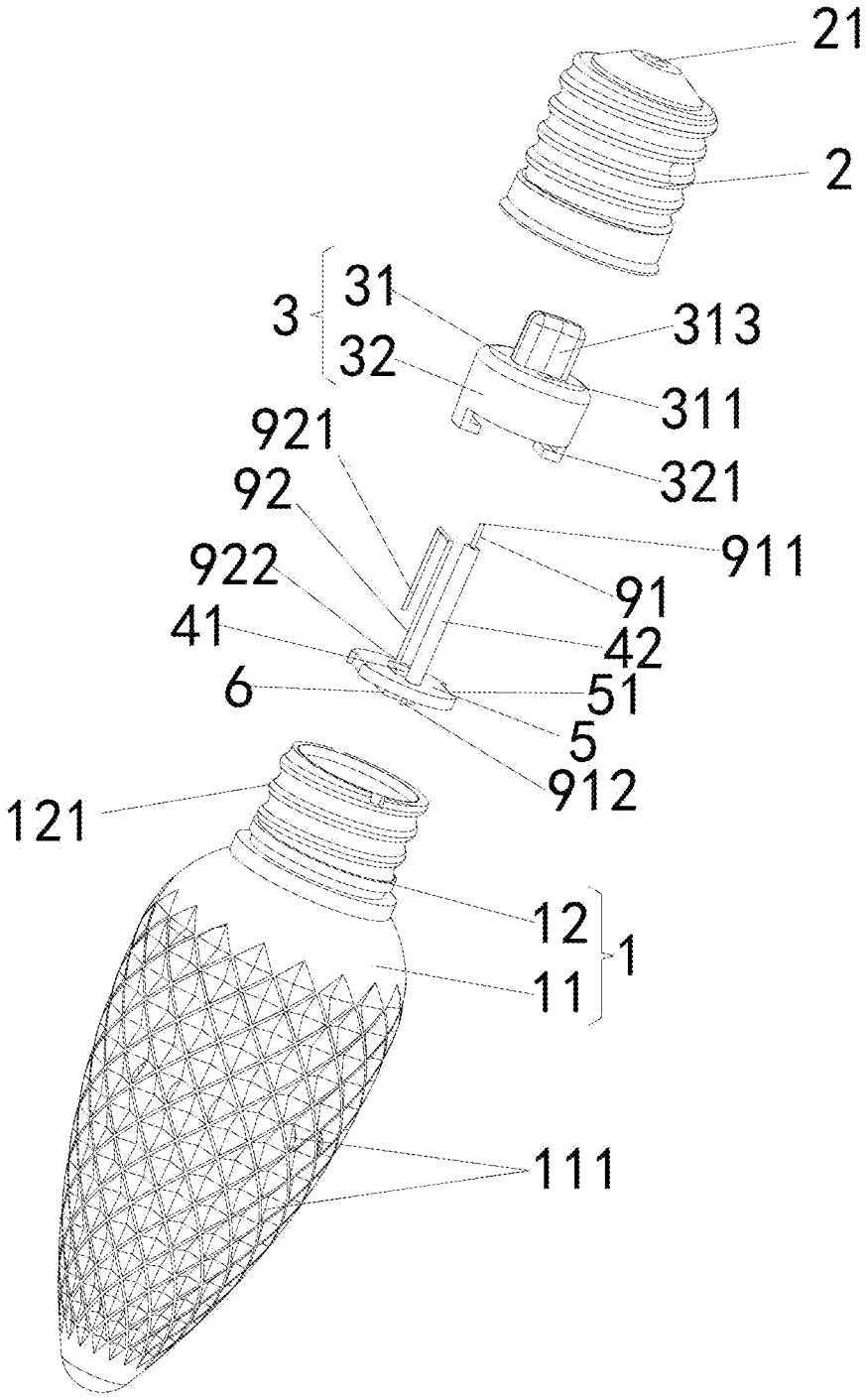
FIG. 4 is a disassembled structural schematic view of the Embodiment 1 of the present invention.

In the figures: 1 denotes the lampshade; 11 denotes the lampshade body; 111 denotes the lampshade grooves; 12 denotes the mounting part; 121 denotes the screw-threaded surface; 13 denotes the inner hole; 2 denotes the lamp holder; 21 denotes the land hole; 3 denotes the lamp pole; 31 denotes the first flat surface; 311 denotes the first through hole; 312 denotes the second through hole; 313 denotes the gripping part; 32 denotes the annular side wall; 321 denotes the supporting platform; 33 denotes the annular groove; 34 denotes the first lamp pole; 341 denotes the protruding block; 35 denotes the second lamp pole; 351 denotes the recess; 36 denotes the first limiting protruding pole member; 41 denotes the first electronic component; 42 denotes the second electronic component; 43 denotes the third electronic component; 5 denotes the PCB; 51 denotes the PCB groove; 6 denotes the LED; 7 denotes the glue; 8 denotes the sealing ring; 91 denotes the first wire; 911 denotes the first electrical connection end; 912 denotes the first connection end; 92 denotes the second wire; 921 denotes the second electrical connection end; 922 denotes the second connection end.

DETAILED DESCRIPTION OF THE INVENTION

The present invention is clearly and completely described herein with reference to the accompanying drawings of the embodiments of the present invention.

Embodiment 1, with Reference to FIGS. 1 to 4

The present invention provides a lighting apparatus comprising a first wire 91, a second wire 92, a lampshade 1, a lamp holder 2 connected to the lampshade 1, and an electronic component and a light source component which are electrically connected with each other and disposed inside the lampshade 1. The lampshade 1 is a translucent plastic lampshade. The lampshade 1 can be formed by integral blow molding to enhance drop resistance capability and prevent using open fire during manufacture.

The lampshade 1 comprises a lampshade body 11 and a mounting part 12 integrally connected on the lampshade body 11. The mounting part 12 is inserted into the lamp holder 2. The lampshade body 11 has an outer surface which is provided with a plurality of evenly arranged lampshade grooves 111. In this way, there is refraction of light when light passes through the lampshade body 11 to produce a more gorgeous lighting effect. The lampshade body 11 has a shape which is identical to the lampshade 1 of a traditional tungsten lamp, but the specific shape can be designed according to actual needs. The mounting part 12 has an inner hole 13 for connecting an inner cavity of the lampshade body 11 and exterior space of the lampshade body 11. The light source component is disposed in the inner hole 13.

The light source component comprises a PCB 5. The PCB 5 has a first side which has at least one LED 6 adhered or welded thereon, and a second side which has a first electronic component 41 adhered or welded thereon. The LED 6 is disposed on the first side of the PCB 5 which faces towards the inner hole 13.

The first wire 91 comprises a first electrical connection end 911 which is electrically connected with a power supply and a first connection end 912 which is electrically connected with the PCB 5. The second wire 92 comprises a second electrical connection end 921 which is electrically connected with the power supply and a second connection end 922 which is electrically connected with the PCB 5. It is worth mentioning that the first wire 91 could be a fire wire connected with commercial power and the second wire 92 could be a zero line connected with commercial power.

The electronic component comprises a first electronic component 41 and a second electronic component 42. The first electronic component 41 is disposed on the PCB 5 and electrically connected with the PCB 5. The first wire 91 is electrically connected with the second electronic component 42. The second connection end 922 of the second wire 92 is electrically connected with the PCB 5. Preferably, the first electronic component 41 is in form of a bridge rectifier which is conventionally used in the marketplace; the second electronic component 42 is in form of a resistor which is conventionally used in the marketplace. It is worth mentioning that if a resistor is used as the second electronic component 42, the lead of the resistor would correspondingly become the first wire 91 in this embodiment.

The lamp pole 3 is a cylindrical lamp pole. The lamp pole 3 is integrally formed by injection molding. The lamp pole 3 comprises a first flat surface 31 and an annular side wall 32 standing on the first flat surface 31. The annular side wall 32 and the first flat surface 31 form a positioning frame which is open at one side. A first through hole 311 and a second through hole 312 are symmetrically open on the first flat surface 31. Both the first through hole 311 and the second through hole 312 extend from a first side of the first flat surface 31 to a second side of the first flat surface 31. The second electronic component 42 passes through the first through hole 311 and is disposed inside the first through hole 311. The second wire 92 passes through the second through hole 312 and is disposed inside the second through hole 312.

The annular side wall 32 has a diameter which decreases gradually from a first end of the annular side wall 32 which is connected with the first flat surface 31 to a second end of the annular side wall 32. The first end of the annular side wall 32 which is connected with the first flat surface 31 has a diameter which is slightly larger than a diameter of the mounting part 12 so as to achieve interference fit between the lamp pole 3 and the mounting part 12. The lamp pole 3 is made of flame retardant and fireproof plastic material to enhance heat dissipation of the lighting apparatus, so that heat generated from the first electronic component 41, the second electronic component 42, the PCB 5 and the LED 6 during operation could be dissipated in time, thus increasing usage life of the lighting apparatus. With the interference fit between the lamp pole 3 and the mounting part 12, a good seal is formed between the lamp pole 3 and the lampshade 1 to achieve water proof effect for the first electronic component 41, the PCB 5 and the LED 6 in the lampshade body 11, thus effectively increasing the waterproof level of the lighting apparatus. On the other hand, the lamp pole 3 is inserted in the mounting part 12. With the interference fit between the lamp pole 3 and the mounting part 12, fixed connection between the lamp pole 3 and the mounting part 12 can be achieved.

The side of the annular side wall 32 which is distant from the first flat surface 31 is provided with a supporting platform 321 for preventing the PCB 5 from disengaging from the lamp pole 3. The supporting platform 321 is in form of two hooks symmetrically provided on the annular side wall 32. Two PCB grooves 51 which correspond to the two hooks are provided on the PCB 5 at positions corresponding to the two hooks. Distance between the two PCB grooves 51 is slightly larger than distance between the two hooks, so that the PCB 5 could be pressed to insert the PCB grooves 51 into the supporting platform 321 and snap on the supporting platform 321 to securely position the PCB 5 on the lamp pole 3.

The first flat surface 31 is provided with a gripping part 313 in a middle part thereof for facilitating gripping by hand or mechanical hand. The first through hole 311 and the second through hole 312 are disposed at two sides of the gripping part 313 respectively. A receiving space for filing with glue 7 is formed between an outer wall of the gripping part 313 and an inner wall of the mounting part 12. In this way, not only the connection is more secured, but also the lampshade 1 and the lamp holder 2 is not easy to disengage from each other under external force during installation of the lighting apparatus; the waterproof level of the lighting apparatus is also effectively increased.

Figure 5:
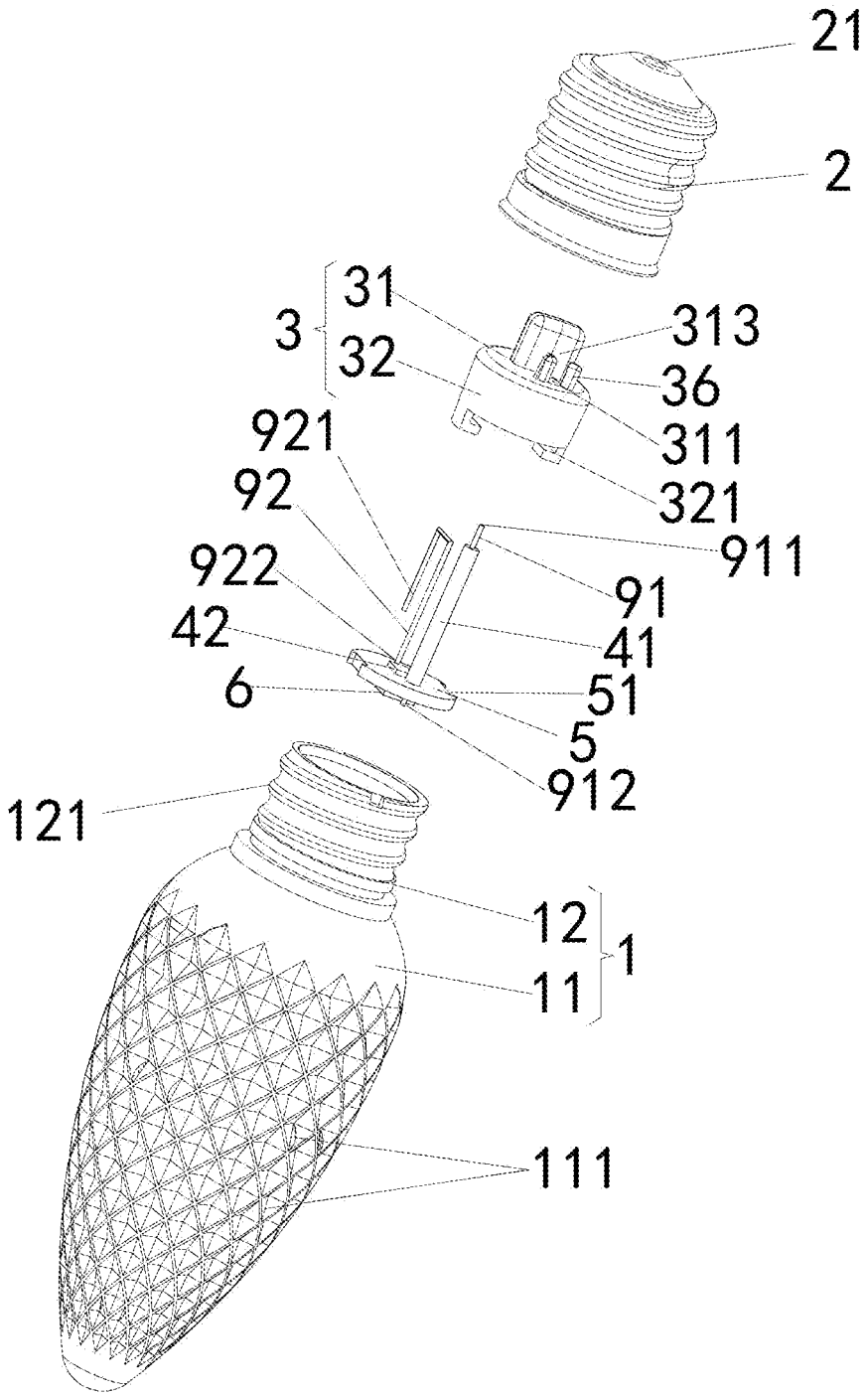
FIG. 5 is a disassembled structural schematic view of the Embodiment 2 of the present invention.

Embodiment 2, with Reference to FIGS. 1 and 5

The present embodiment is different from Embodiment 1 in that a first limiting protruding pole member 36 is arranged to extend towards a direction away from the PCB 5 from a periphery of the first through hole 311 to prevent displacement of the second electronic component 42, and/or a second limiting protruding pole member (not shown in the drawings) is arranged to extend towards the direction away from the PCB 5 from a periphery of the second through hole 312. It is worth mentioning that the first limiting protruding pole member 36 is provided to prevent circumferential displacement of the second electronic component 42 during assembly. In particular, the first limiting protruding pole member 36 is formed by a plurality of protruding poles having certain elasticity. When the second electronic component 42 protrudes from the first through hole 311 and passes through the first limiting protruding pole member 36, the first limiting protruding pole member 36 is elastically deformed and wraps around a side wall of the second electronic component 42 so as to secure the second electronic component 42 in the first through hole 311. The first limiting protruding pole member 36 effectively limits circumferential displacement of the second electronic component 42, thereby reducing attrition rate of the lighting apparatus.

Figure 6:
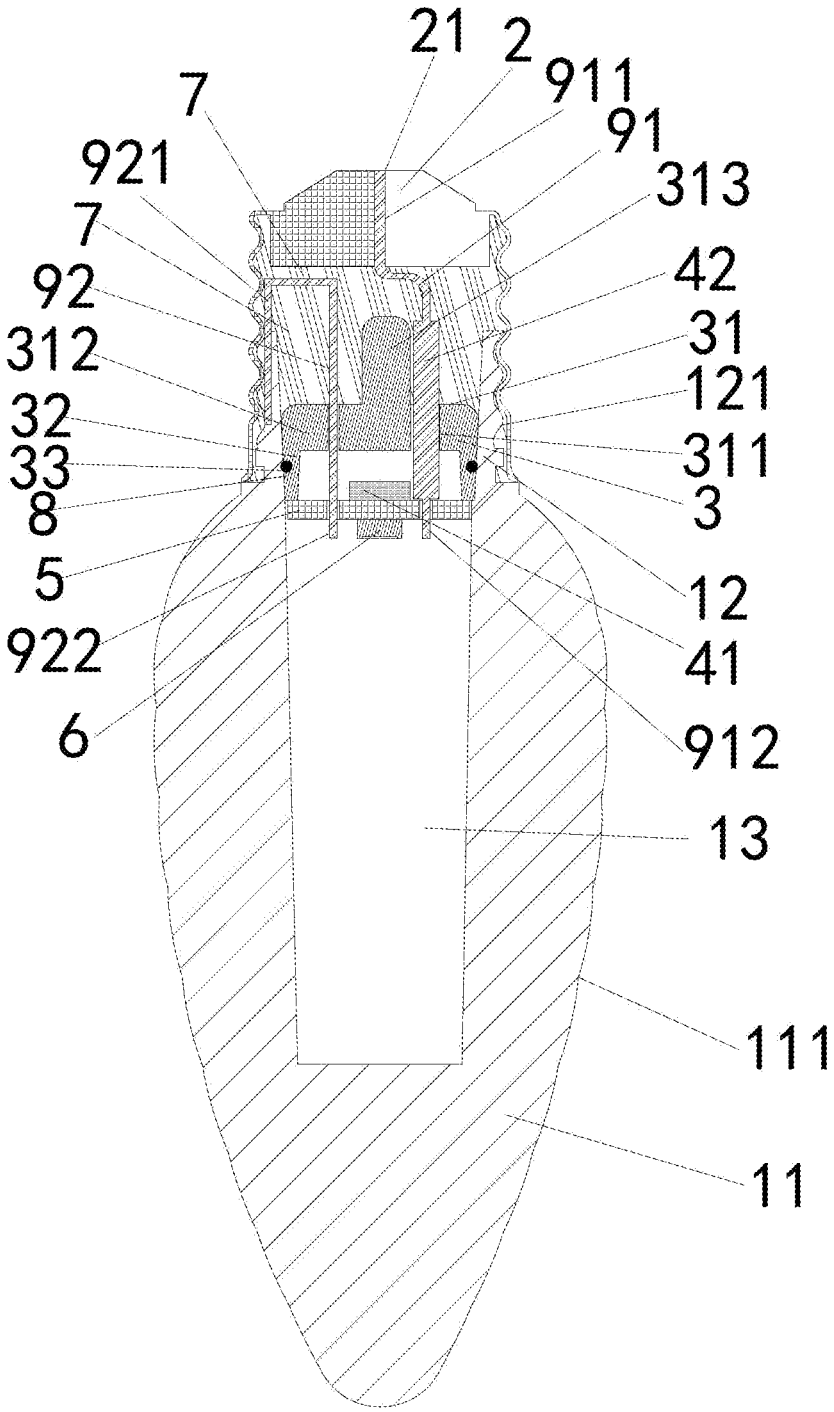
FIG. 6 is a sectional structural schematic view of the Embodiment 3 of the present invention.
Figure 7:
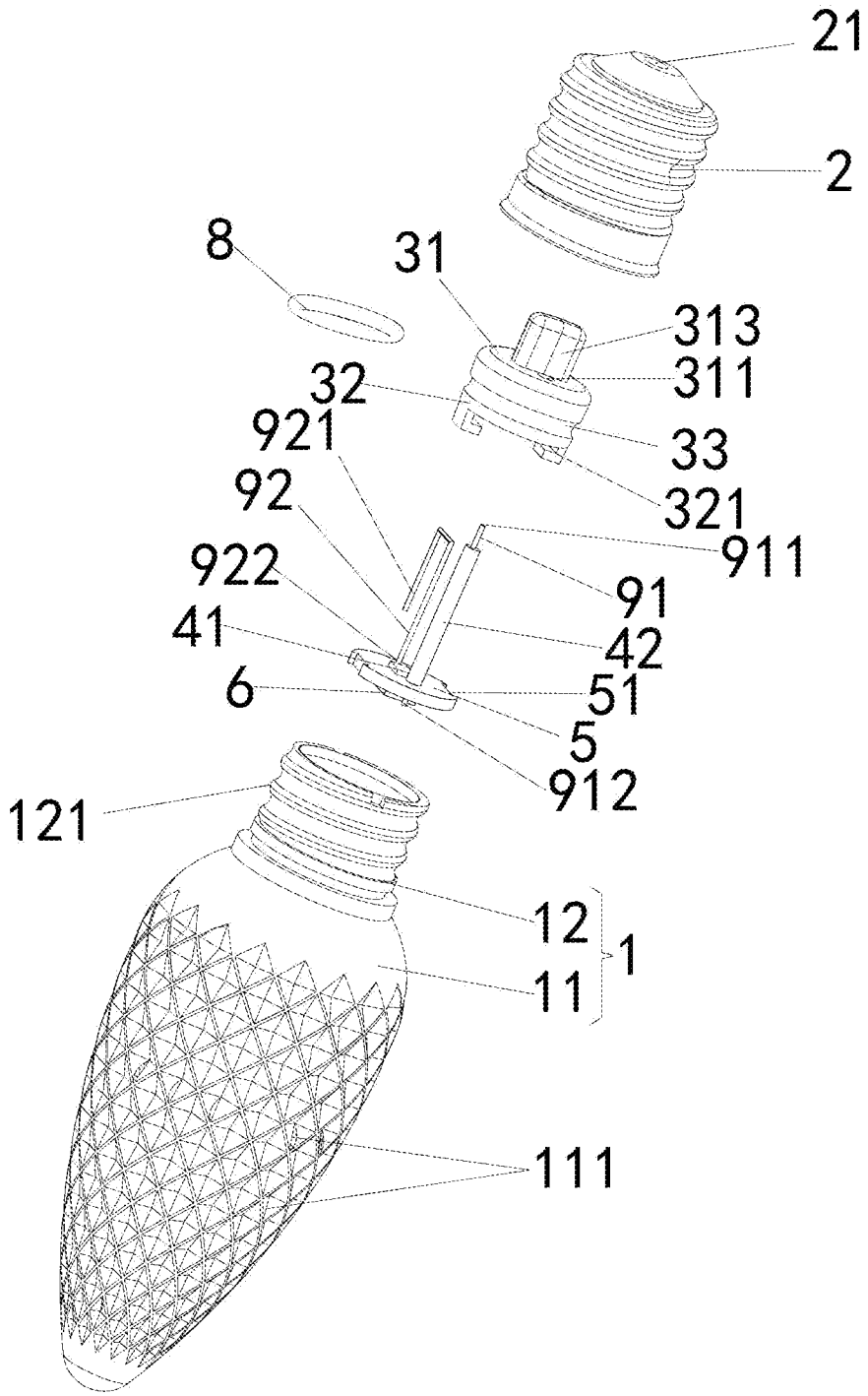
FIG. 7 is a disassembled structural schematic view of the Embodiment 3 of the present invention.
Figure 8:
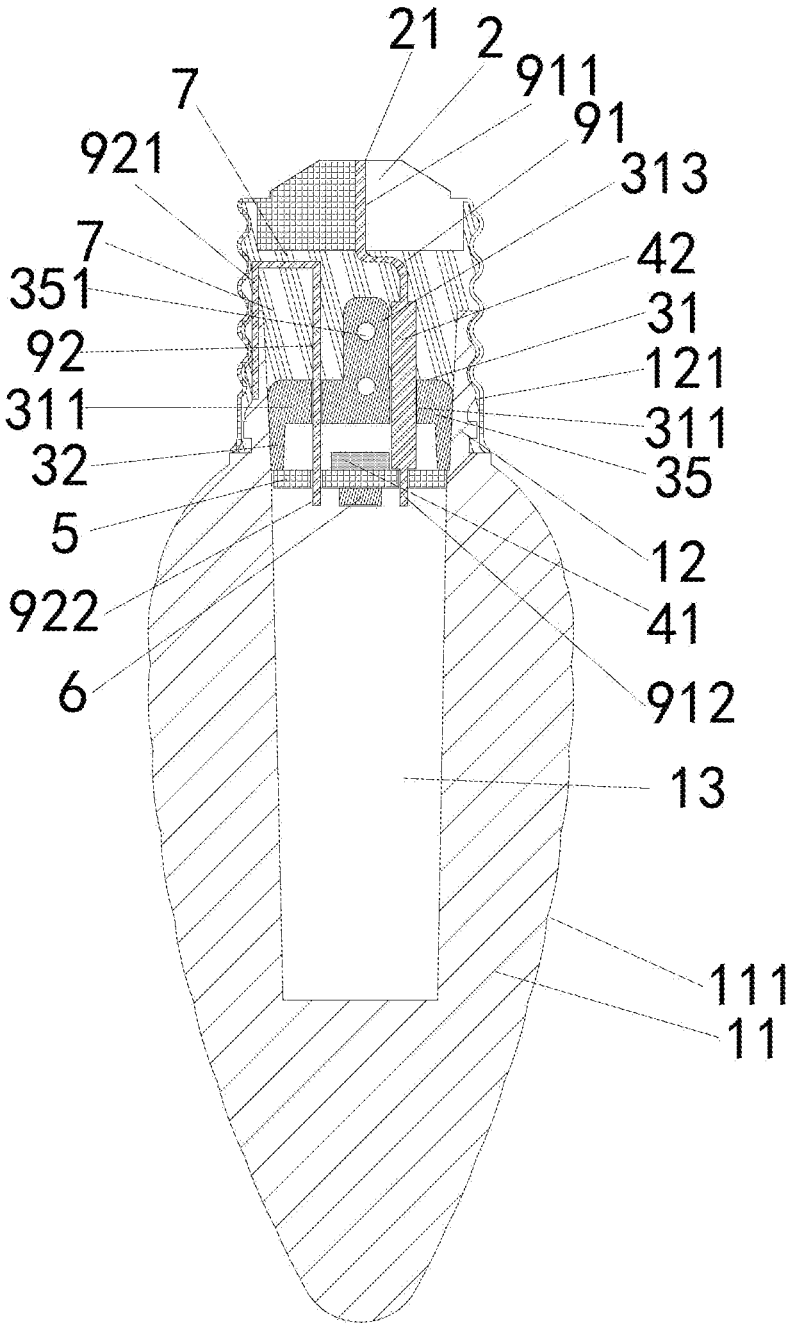
FIG. 8 is a sectional structural schematic view of the Embodiment 4 of the present invention.
Figure 9:
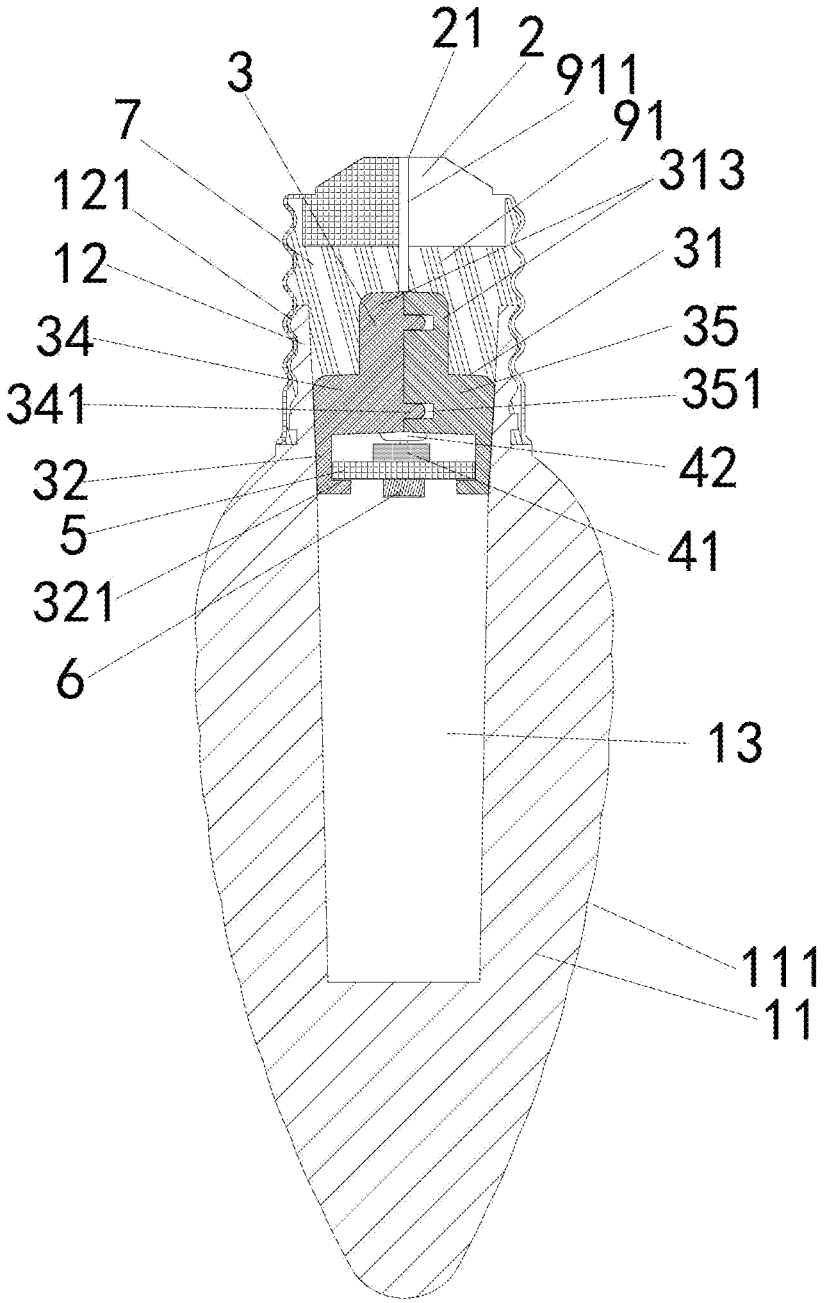
FIG. 9 is another sectional structural schematic view of the Embodiment 4 of the present invention.
Figure 10:
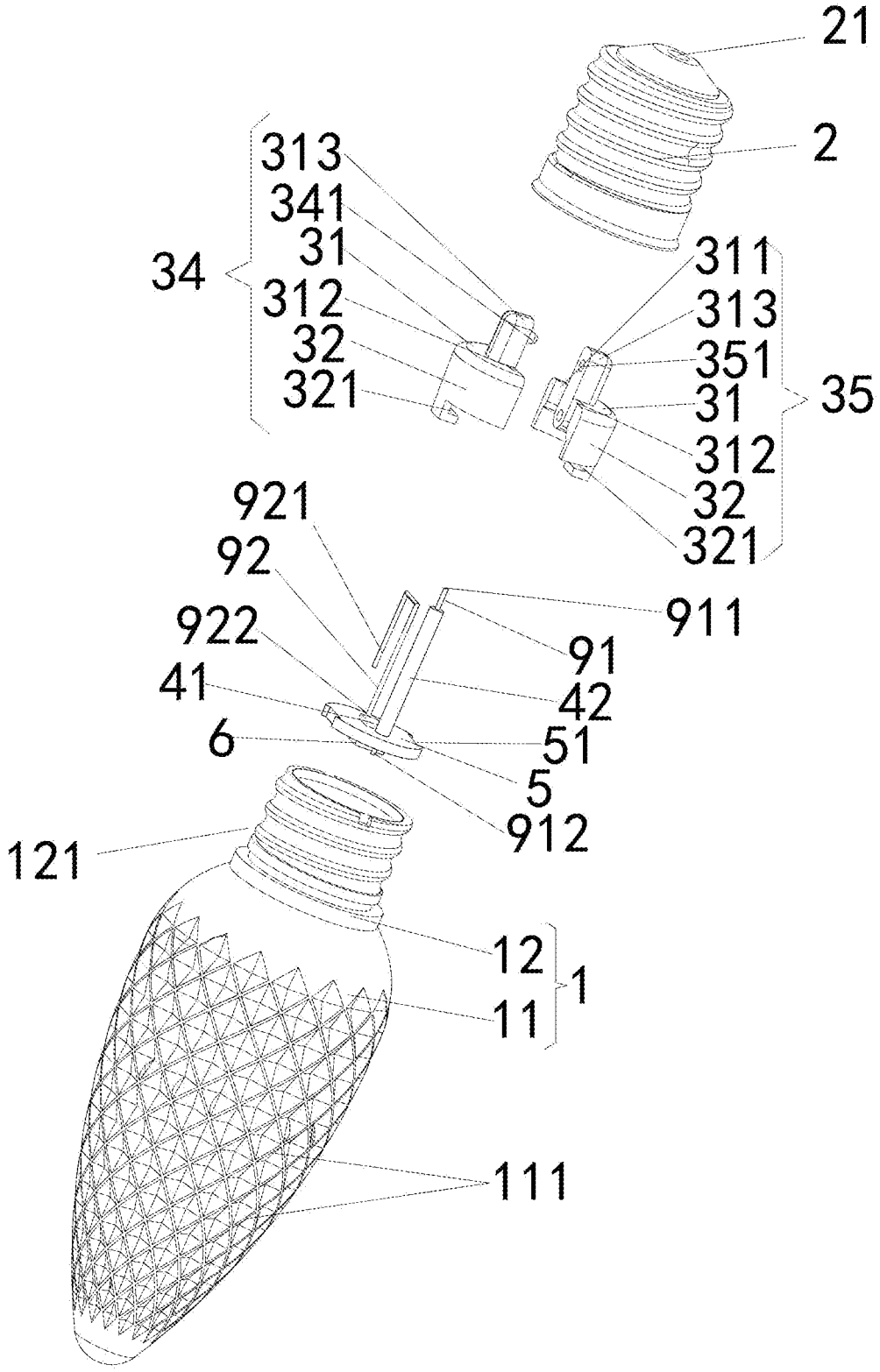
FIG. 10 is a disassembled structural schematic view of the Embodiment 4 of the present invention.

Embodiment 3, with Reference to FIGS. 1, 6 and 7

The present embodiment is different from Embodiment 1 in that an annular groove 33 is provided circumferentially on an outer surface of the lamp pole 3. A sealing ring 8 is disposed in the annular groove 33. As a result, the LED 6 in the lampshade 1 has good waterproof effect, and the sealing effect between the lamp pole 3 and the lampshade 1 is further increased.

Embodiment 4, with Reference to FIGS. 1, 8 to 10

The present embodiment is different from Embodiment 1 in that the lamp pole 3 comprises a first lamp pole 34 and a second lamp pole 35 connected with the first lamp pole 34. A snapping mechanism for snap connection is provided on a first side of the first lamp pole 34 and a first side of the second lamp pole 35 which face each other. The snapping mechanism comprises a protruding block 341 disposed on the first lamp pole 34 and a recess 351 disposed on the second lamp pole 35. The recess 351 is disposed corresponding to position of the protruding block 341. By snap connection between the protruding block 341 and the recess 351, the first lamp pole 34 and the second lamp pole 35 could be fixedly connected with each other.

Figure 11:
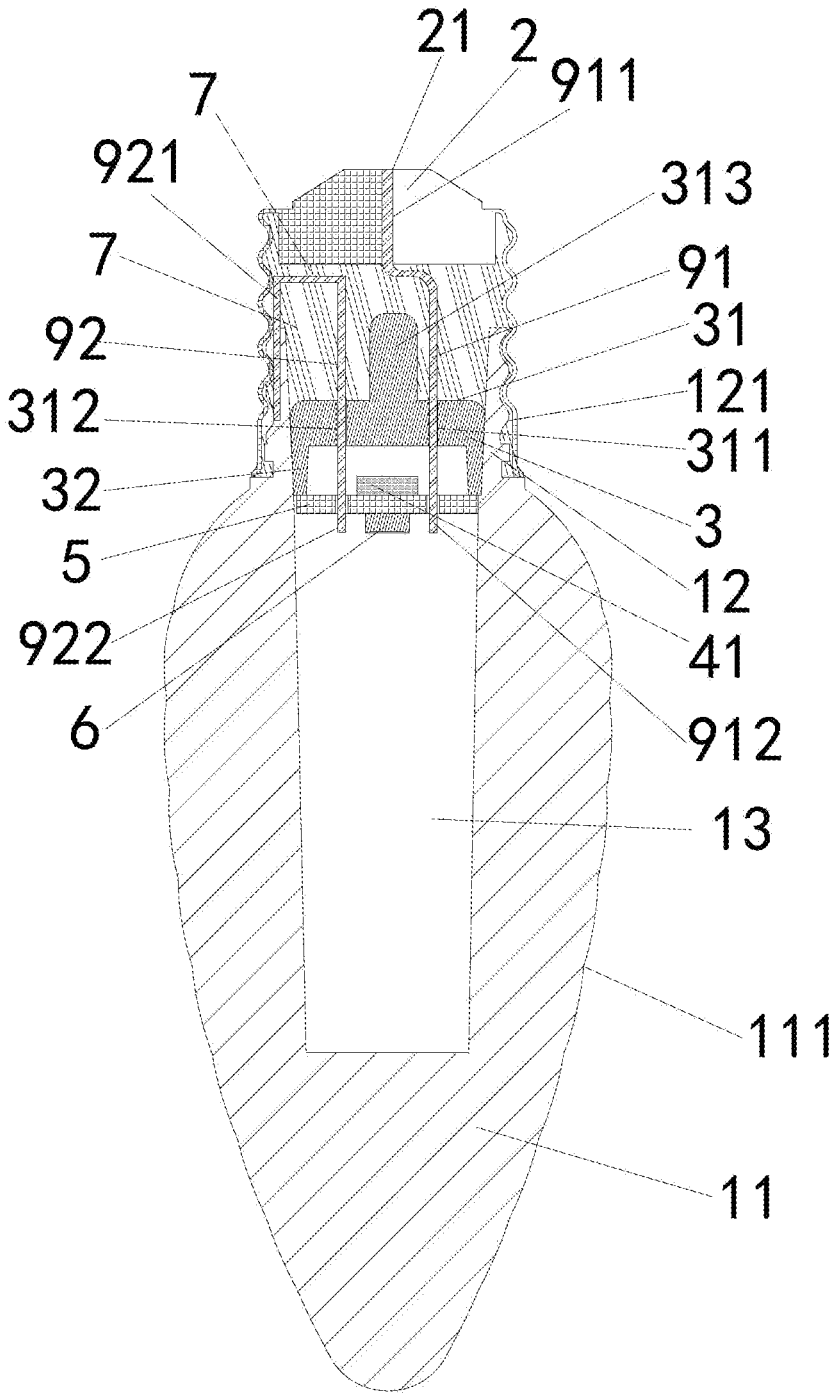
FIG. 11 is a sectional structural schematic view of the Embodiment 5 of the present invention.
Figure 12:
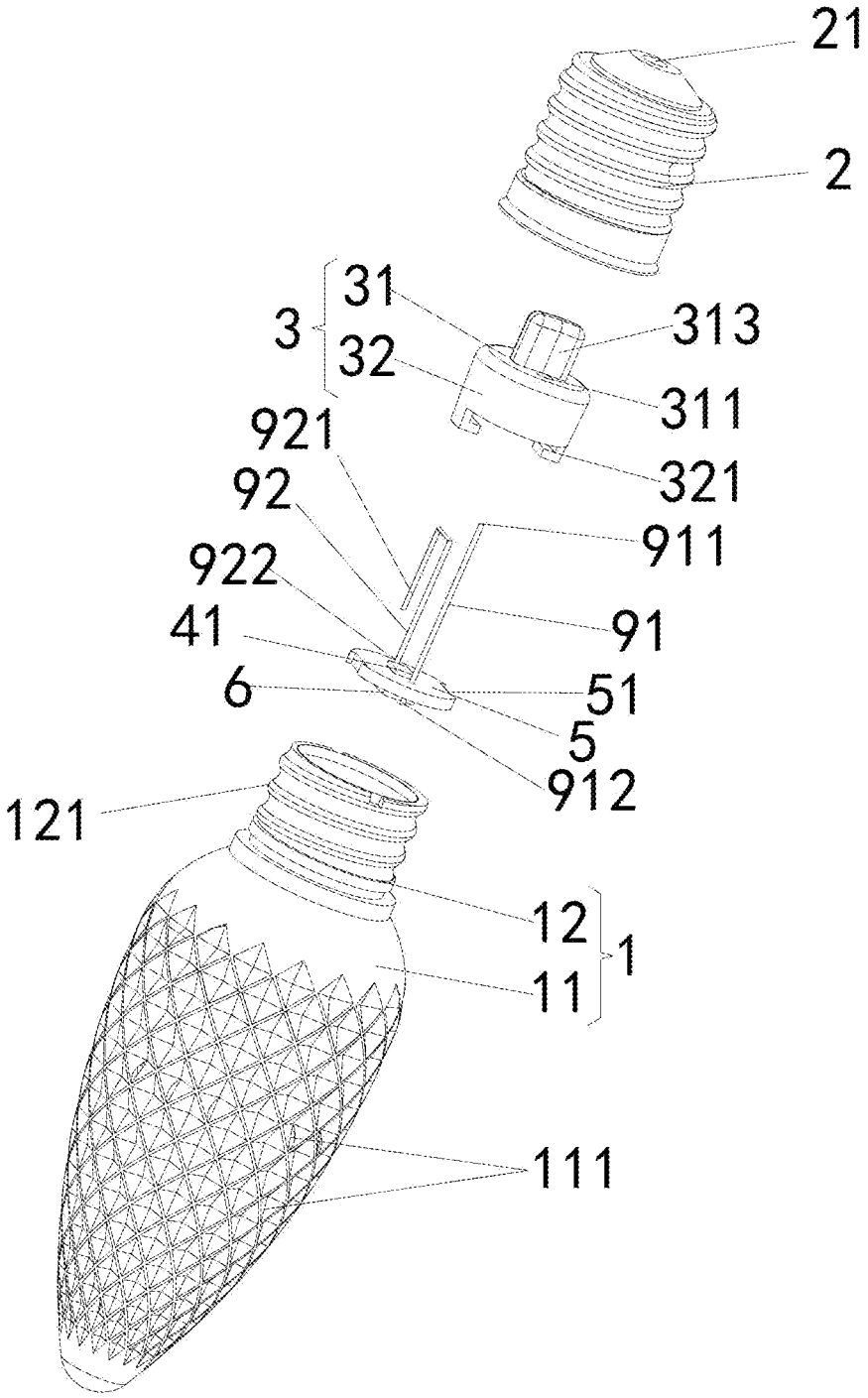
FIG. 12 is a disassembled structural schematic view of the Embodiment 5 of the present invention.

Embodiment 5, with Reference to FIGS. 1, 11 to 12

The present embodiment is different from Embodiment 1 in that the electronic component comprises the first electronic component 41. The first electronic component 41 is disposed on the PCB 5 and electrically connected with the PCB 5. The first wire 91 and the second wire 92 are electrically connected with the PCB 5 respectively. The first wire 91 passes through the first through hole 311 and is disposed in the first through hole 311. The second wire 92 passes through the second through hole 312 and is disposed in the second through hole 312. Preferably, the first electronic component 41 in the present embodiment is in form of a bridge rectifier which is conventionally used in the marketplace.

Figure 13:
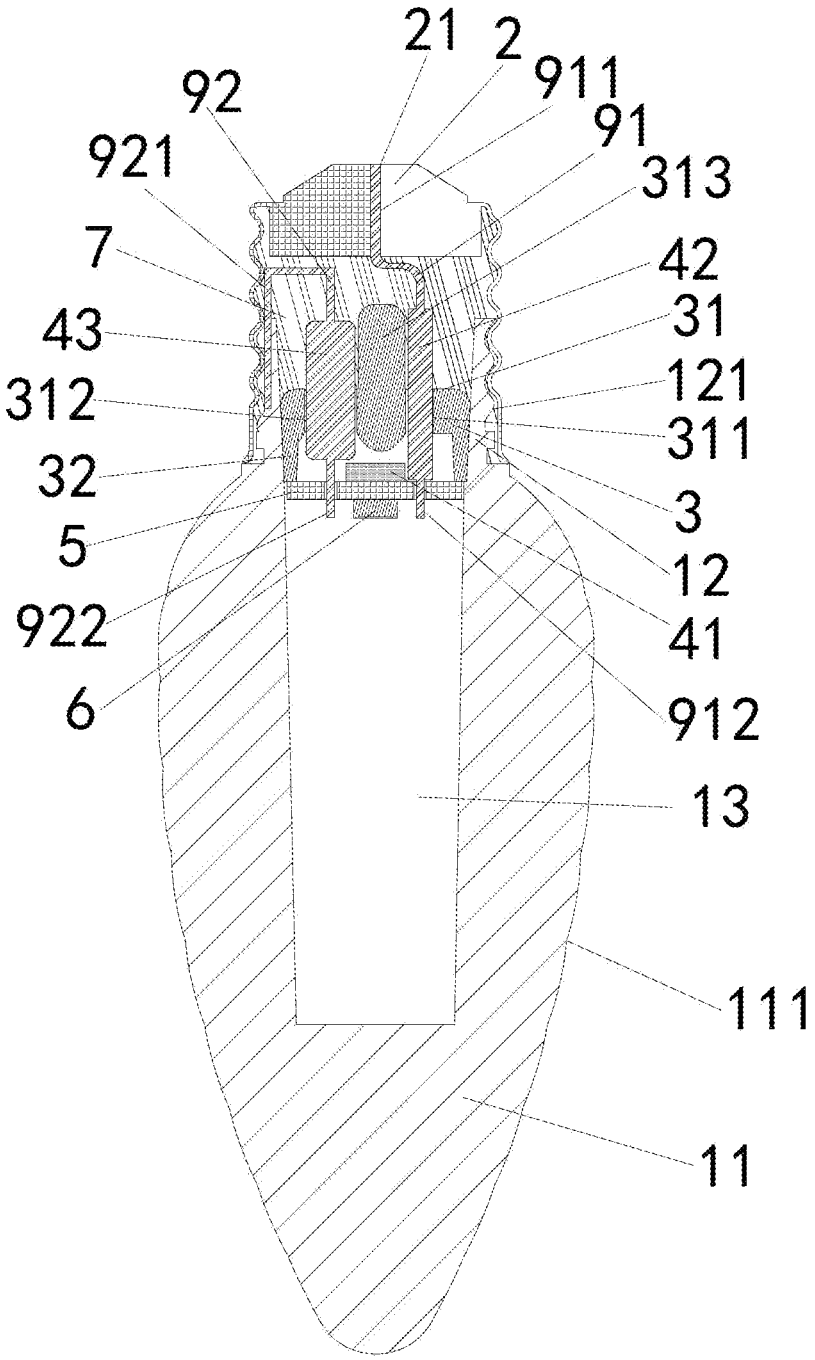
FIG. 13 is a sectional structural schematic view of the Embodiment 6 of the present invention.
Figure 14:
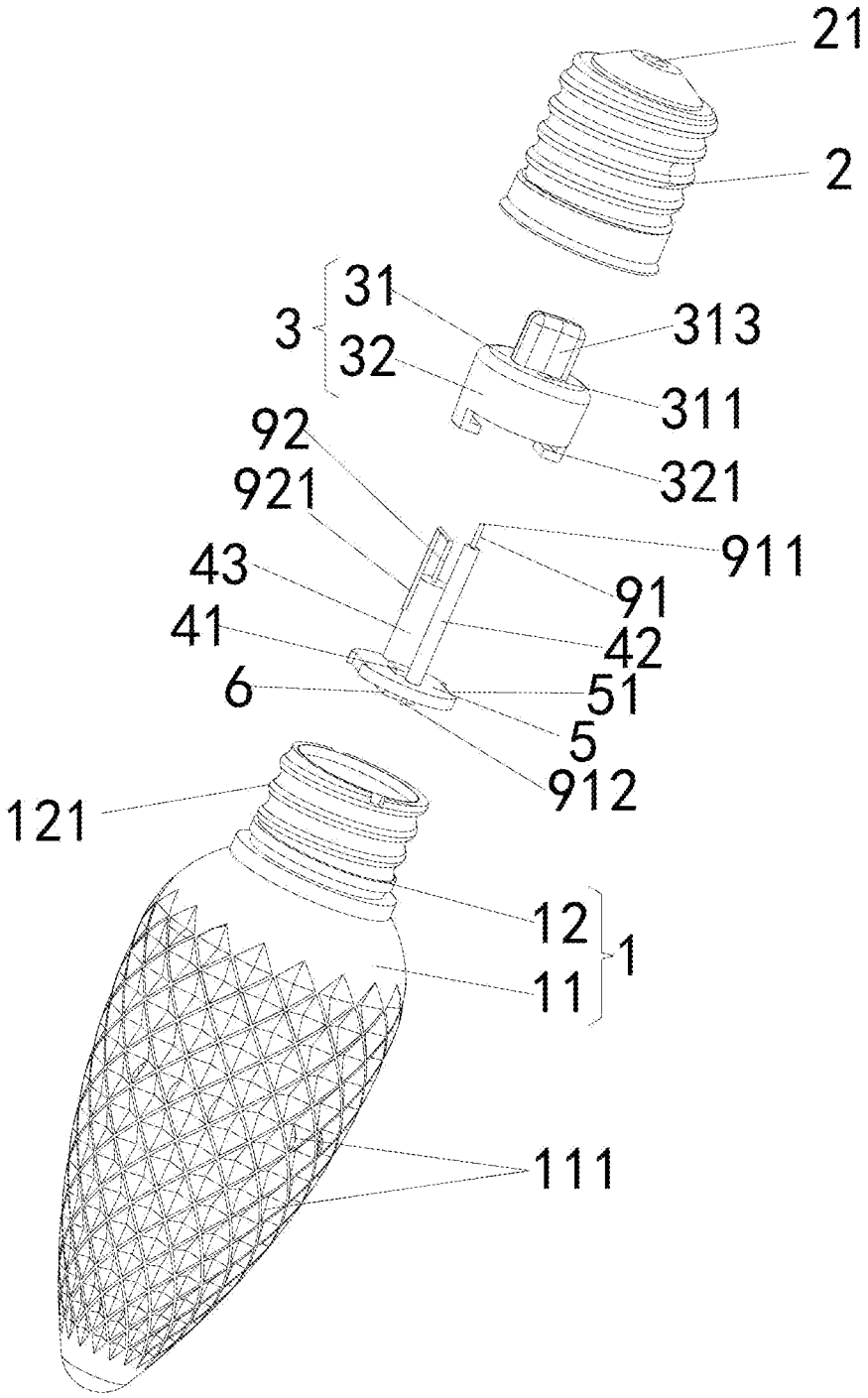
FIG. 14 is a disassembled structural schematic view of the Embodiment 6 of the present invention.

Embodiment 6, with Reference to FIGS. 1, 13 to 14

The present embodiment is different from Embodiment 1 in that the electronic component comprises a first electronic component 41, a second electronic component 42 and a third electronic component 43. The first electronic component 41 is disposed on the PCB 5 and electrically connected with the PCB 5. The first wire 91 is electrically connected with the second electronic component 42. The second wire 92 is electrically connected with the third electronic component 43. The second electronic component 42 passes through the first through hole 311 and is disposed in the first through hole 311. The third electronic component 43 passes through the second through hole 312 and is disposed in the second through hole 312. Preferably, in this embodiment, the first electronic component 41 is in form of a bridge rectifier which is conventionally used in the marketplace; both the second electronic component 42 and the third electronic component 43 are in form of resistors which are conventionally used in the marketplace. It is worth mentioning that if resistors are used as the second electronic component 42 and the third electronic component 43, the lead of the resistor that forms the second electronic component 42 correspondingly becomes the first wire 91 in this embodiment; the lead of the resistor that forms the third electronic component 43 correspondingly becomes the second wire 92 in this embodiment.

Preferably, a first limiting pole member 36 is arranged to extend towards a direction away from the PCB 5 from a periphery of the first through hole 311 to prevent displacement of the second electronic component 42. A second limiting protruding pole member (not shown in the drawings) is arranged to extend towards the direction away from the PCB 5 from a periphery of the second through hole (not shown in the drawings). It is worth mentioning that the first limiting protruding pole member 36 is provided to prevent circumferential displacement of the second electronic component 42 during assembly; the second limiting protruding pole member is provided to prevent circumferential displacement of the third electronic component 43 during assembly. In particular, each of the first limiting protruding pole member 36 and the second limiting pole member is formed by a plurality of protruding poles having certain elasticity. When the second electronic component 42 protrudes from the first through hole 311 and passes through the first limiting protruding pole member 36, the plurality of protruding poles of the first limiting protruding pole member 36 are all elastically deformed and wrap around a side wall of the second electronic component 42 so as to secure the second electronic component 42 in the first through hole 311; when the third electronic component 43 protrudes from the second through hole 312 and passes through the second limiting protruding pole member, the plurality of protruding poles of the second limiting protruding pole member are all elastically deformed and wrap around a side wall of the third electronic component 43 so as to secure the third electronic component 43 in the second through hole 312. The first limiting protruding pole member 36 effectively limits circumferential displacement of the second electronic component 42 and the second limiting protruding pole member effectively limits circumferential displacement of the third electronic component 43, thereby reducing attrition rate of the lighting apparatus.

With the aforementioned technical proposal, the lighting apparatus of the present invention has the following advantageous effects:

1. With the interference fit between the mounting part 12 and the lamp pole 13, the lamp pole 13 is pressed into the mounting part 12 of the lampshade 1, thereby forming a good sealing effect between the lamp pole 13 and the lampshade 1, so that the LED 6 in the lampshade 1 has good waterproof effect, and the waterproof level of the lighting apparatus is increased;

2. By arranging the first wire 91 or the second electronic component 42 to pass through the first through hole 311 and the second wire 92 or the third electronic component 43 to pass through the second through hole 312, the first through hole 311 effectively limits circumferential displacement of the first wire 91 or the second electronic component 42, and the second through hole 312 effectively limits circumferential displacement of the second wire 92 or the third electronic component 43, thereby reducing attrition rate of the lighting apparatus;

3. As the lamp pole 3 is made of flame retardant and fireproof material, heat generated from the PCB 5, the LED 6, the first electronic component 41 and/or the second electronic component 42 and/or the third electronic component 43 could be dissipated in time, thus increasing usage life of the lighting apparatus;

4. The sealing ring 8 disposed on the periphery of the lamp pole 3 improves the waterproof effect of the LED 6 in the lampshade 1, thus further increasing the sealing effect between the lamp pole 3 and the lampshade 1, and further effectively increasing the waterproof level of the lighting apparatus;

5. By filling glue 7 in the receiving space, the lamp pole 3 and the mounting part 12 are not easy to disengage from each other under external force, thereby further effectively increasing the waterproof level of the lighting apparatus.

The present embodiment also provides a manufacturing method of the lighting apparatus of the aforementioned embodiments. The manufacturing method comprises the following steps:

S1: Heat transparent plastic material using industrial injection molding machine, and then inject the plastic material into a lampshade mold to obtain the lampshade 1 by injection molding;

S2: Heat transparent plastic material using industrial injection molding machine, and then inject the plastic material into a lamp pole mold to obtain the lamp pole 3 in desired shape by injection molding; the lamp pole 3 is formed together with the first through hole 311, the second through hole 312, the gripping part 313, the supporting platform 321 and the recess 351;

S3: Apply solder paste or red glue at mounting position of electronic components of the PCB 5, and then affix the LED 6 and the first electronic component 41 on corresponding positions of the PCB 5 by SMT (automatic chip mounter), and then weld the LED 6 and the first electronic component 41 on the PCB 5 by reflow soldering;

S4: Insert a first connection end 911 (or one of the leads of the second electronic component 42) and a second connection end 921 (or one of the leads of the third electronic component 43) corresponding to L, N labels of the PCB 5, and then apply solder;

S5: Inspect visually if surface of the PCB is clean, and whether there is any missing solder or whether there is sufficient solder at the LED 6, the first electronic component 41, the first connection end 912 (or one of the leads of the second electronic component 42) and the second connection end 922 (or one of the leads of the third electronic component 43); then use AC120V 60 HZ power supply and perform lighting test using a test probe;

S6: Pass the first wire 91 (or the second electronic component 42) and the second wire 92 (or the third electronic component 43) through the first through hole 311 and the second through hole 321 respectively, and align the PCB grooves 51 of the PCB 5 with the supporting platform 321 and then press and rest it on the supporting platform 321;

S7: Grip the gripping part 313 to align the components in Step S6 with the mounting part 12 and press and install the same in place;

S8: The outer wall of the gripping part 313 and the inner wall of the mounting part 12 form the receiving space; the components in Step S7 are placed on a glue dispensing work table, and a glue dispensing machine targets position of the receiving space and drip appropriate amount of glue 7 therein;

S9: Bend the second electrical connection end 921 (or another lead of the third electronic component 43) from a side of the lampshade 1 to adhere to a screw-threaded surface 121 of the lampshade 1, and pass the first electrical connection end 911 (or the second electronic component 42) through a land hole 21 on a top part of the lamp holder 2, and then screw a screw socket of the lamp holder 2 according to its thread direction to tightly engage with the lampshade 1;

S10: Apply solder to the land hole 21 on the top part of the lamp holder 2, then use an electric soldering iron to apply solder on welding points, wherein the welding points are required to be in circular shape, smooth in surface and without burrs;

S11: Inspect visually outer appearance of the lighting apparatus with solidified glue 7, and check whether there is any glue leakage, whether the screw socket is in place, and whether there is any foreign matter in the lampshade 1, then use AC120V 60 HZ power to perform testing.

With the aforementioned technical proposal, the manufacturing method of the present invention is simpler and lower in costs.

Although some embodiments of the present invention have been described above, a person skilled in the art may make other changes, modifications, substitutions and variations based on the described embodiments without departing from the principles and spirits of the present invention. The scope of the present invention is defined by the accompanying claims and equivalents thereof.

What is claimed is:

1. A lighting apparatus comprising a lampshade, a lamp holder connected to the lampshade, and an electronic component and a light source component which are electrically connected with each other and disposed inside the lampshade; the lampshade comprises a lampshade body and a mounting part integrally connected on the lampshade body; the mounting part is inserted into the lamp holder; characterized in that: the mounting part is engaged with a lamp pole by interference fit; the lamp pole is provided with through holes for the electronic component or wire to pass through; each of the through holes passes from a first side of the lamp pole to a second side of the lamp pole: the lamp pole is a cylindrical lamp pole; the lamp pole has a diameter which decreases gradually from a first end close to the lamp holder to a second end distant from the lamp holder.

2. The lighting apparatus as in claim 1, characterized in that: it further comprises a first wire and a second wire; the first wire comprises a first electrical connection end which is electrically connected with a power supply and a first connection end which is electrically connected with the light source component; the second wire comprises a second electrical connection end which is electrically connected with the power supply and a second connection end which is electrically connected with the light source component.

3. The lighting apparatus as in claim 2, characterized in that: the electronic component comprises a first electronic component; the first electronic component is disposed on the light source component and electrically connected with the light source component; the first wire and the second wire are respectively electrically connected with the light source component; the through holes comprise a first through hole and a second through hole; the first wire passes through the first through hole and is disposed in the first through hole; the second wire passes through the second through hole and is disposed in the second through hole.

4. The lighting apparatus as in claim 2, characterized in that: the electronic component comprises a first electronic component and a second electronic component; the first electronic component is disposed on the light source component and electrically connected with the light source component; the first wire is electrically connected with the second electronic component; the second wire is electrically connected with the light source component; the through holes comprise a first through hole and a second through hole; the second electronic component passes through the first through hole and is disposed in the first through hole; the second wire passes through the second through hole and is disposed in the second through hole.

5. The lighting apparatus as in claim 2, characterized in that: the electronic component comprises a first electronic component, a second electronic component and a third electronic component; the first electronic component is disposed on the light source component and electrically connected with the light source component; the first wire is electrically connected with the second electronic component; the second wire is electrically connected with the third electronic component; the through holes comprise a first through hole and a second through hole; the second electronic component passes through the first through hole and is disposed in the first through hole; the third electronic component passes through the second through hole and is disposed in the second through hole.

6. The lighting apparatus as in claim 1, characterized in that: the light source component comprises a PCB; the PCB is disposed on one end of the lamp pole; at least one LED is adhered or welded on a side of the PCB which faces towards the lampshade body.

7. The lighting apparatus as in claim 6, characterized in that: a supporting platform is provided on a side of the lamp pole which is close to the PCB for preventing the PCB from disengaging from the lamp pole; PCB grooves which correspond to the supporting platform are provided on the PCB at positions corresponding to the supporting platform; the PCB grooves are snapped on the supporting platform.

8. The lighting apparatus as in claim 1, characterized in that: a gripping part is provided on a side of the lamp pole which is distant from the light source component.

9. The lighting apparatus as in claim 1, characterized in that: a limiting protruding pole member is arranged to extend towards a direction away from the light source component from a periphery of the through hole to prevent displacement of the electronic component.

10. The lighting apparatus as in claim 1, characterized in that: an annular groove is provided circumferentially on an outer surface of the lamp pole; a sealing ring is disposed in the annular groove.

11. The lighting apparatus as in claim 1, characterized in that: the lamp pole comprises a first lamp pole and a second lamp pole connected with the first lamp pole; a snapping mechanism for snap connection is provided on a first side of the first lamp pole and a first side of the second lamp pole which face each other.

12. A lighting apparatus manufacturing method, characterized in that: the lighting apparatus is the lighting apparatus as in claim 4; the light source component comprises a PCB; at least one LED is adhered or welded on the PCB; PCB grooves are disposed on the PCB; it comprises the following steps:

S1: Obtain the lampshade by injection molding;

S2: Obtain the lamp pole by injection molding; the supporting platform and the gripping part are simultaneously formed during injection molding of the lamp pole;

S3: Affix the LED and the first electronic component on corresponding positions of the PCB, and then weld the LED and the first electronic component respectively on the PCB by reflow soldering;

S4: Connect the second electronic component with the first wire by welding;

insert the first connection end and the second connection end corresponding to L, N labels of the PCB, and then apply solder;

S5: Inspect visually if surface of the PCB is clean, and whether there is any missing solder or whether there is sufficient solder at the LED, the first electronic component, the first connection end and the second connection end; then use AC120V 60 HZ power supply and perform lighting test using a test probe;

S6: Pass the second electronic component and the second wire through the first through hole and the second through hole respectively, then press and rest the PCB grooves of the PCB on the supporting platform to obtain a first assembled part;

S7: Align the first assembled part obtained in Step S6 with the mounting part and press and install the same in place;

S8: An outer wall of the gripping part and an inner wall of the mounting part form a receiving space; drip appropriate amount of glue in the receiving space;

S9: Bend the second electrical connection end from a side of the lampshade to adhere to a screw-threaded surface of the lampshade, and pass the first electrical connection end through a land hole on a top part of the lamp holder, and then screw a screw socket of the lamp holder according to its thread direction to tightly engage with the lampshade;

S10: Apply solder to the land hole on the top part of the lamp holder, wherein welding points are required to be in circular shape, smooth in surface and without burrs;

S11: Inspect visually outer appearance of the lighting apparatus with solidified glue, and check whether there is any glue leakage, whether the screw socket is in place, and whether there is any foreign matter in the lampshade, then use AC120V 60 HZ power to perform testing.

* * * * *